US006793334B2

(12) United States Patent
Blackman et al.

(10) Patent No.: US 6,793,334 B2
(45) Date of Patent: Sep. 21, 2004

(54) BARCODE PRINTING MODULE

(75) Inventors: Jeffrey R. Blackman, Vancouver, WA (US); Richard A. Kelley, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 218 days.

(21) Appl. No.: 10/120,758

(22) Filed: Apr. 11, 2002

(65) Prior Publication Data

US 2003/0193530 A1 Oct. 16, 2003

(51) Int. Cl.[7] ..... B41J 2/00
(52) U.S. Cl. ..... 347/107; 400/103
(58) Field of Search ..... 347/2, 107; 358/1.15; 400/103

(56) References Cited

U.S. PATENT DOCUMENTS 3,911,818 A * 10/1975 Macllvaine ..... 101/494
4,612,554 A * 9/1986 Poleshuk ..... 347/63
4,706,096 A * 11/1987 Sato ..... 347/218
5,262,804 A * 11/1993 Petigrew et al. ..... 347/109
5,326,181 A 7/1994 Eisner et al.
5,547,501 A * 8/1996 Maruyama et al. ..... 106/31.14
6,092,940 A 7/2000 Wiklof et al.
6,203,131 B1 * 3/2001 Wiklof ..... 347/2

FOREIGN PATENT DOCUMENTS

EP 0354815 A2 2/1990
EP 997 837 A2 * 5/2000 ..... G06K/7/12
FR 2252740 A 7/1975

OTHER PUBLICATIONS

Search ReportApplication No. GB 0307636–1 European Patent Office Examiner Marc Collins Date of Search Jul. 28, 2003.

* cited by examiner

*Primary Examiner*—Blaise L. Mouttet

(57) ABSTRACT

Barcodes can be produced by feeding reel-stock media and receiving a drive signal from a printing device. The media receives, exterior of the printing device, print imaging as a barcode pattern or barcode indicia corresponding to the drive signal. Barcode-bearing media is thereby produced externally of the printing device but making use of the printing device resources.

48 Claims, 6 Drawing Sheets

300
RECEIVE PRINT JOB
298
302
BARCODE PRINT JOB ?
NO
YES
304
DISENGAGE BARCODE MODULE ELECTRICAL AND MECHANICAL INTERFACE
320
DISENGAGE INTERNAL PRINTING OPERATIONS
322
ENGAGE BARCODE MODULE ELECTRICAL AND MECHANICAL INTERFACE
306
ENGAGE INTERNAL PRINTING OPERATIONS
308
EXECUTE PRINT JOB
324
EXECUTE BARCODE PRINT JOB

BARCODE PRINTING MODULE

BACKGROUND OF THE INVENTION

The present invention relates generally to printing methods and apparatus, and can relate to production of barcode printout using an inkjet printer.

A barcode can be a series of machine-readable vertical lines organized according to a pattern representing, for example, a numeric or alphanumeric sequence. Barcode presentation can be, however, according to a variety of patterns whereby such patterns represent, for example, numeric or alphanumeric sequences or other such coding. Accordingly, a barcode, as used herein, is a pattern representing numeric, alphanumeric, alpha, or other coding schemes whereby the barcode pattern represents an associated symbol or value. Barcodes can be read or scanned optically by non-contacting remote barcode reading devices. Barcodes are useful in a broad spectrum of applications from grocery checkout applications, where a barcode can represent a product and basis for calculating a charge, to labeling applications where a barcode can represent content or process information relative to a given article. Barcodes can support automated tracking and database reference throughout many industries and applications.

In many cases, barcodes are used to track activity relative to a large number of articles. Accordingly, barcodes are often produced in mass quantity. Mass production of barcodes is often supported by specialized equipment dedicated to high volume operation. Such equipment finds little alternative uses, e.g., finds little use in other more general printing operations. Barcodes are sometimes attached as a label. In other words, barcode patterns or indicia can be applied to media that includes an adhesive surface to provide a barcode label. The adhesive surface attaches the barcode-bearing media to an article associated with the barcode. Barcodes are becoming used more frequently throughout industries and in applications where special or dedicated barcode print imaging equipment may not be available or where cost is excessively prohibitive. In other words, many industries and applications may find advantage in using barcodes, but lack economical barcode-producing equipment capable of efficiently producing barcode labels in mass quantity or even in small batches.

Sheets of labels can be fed through a general purpose printer to produce barcode labels. Such sheet-form labels are provided on a waxy backsheet and come in standard sizes, e.g., standardized for common printer media transport mechanisms. In such production of barcodes, the labels receive print imaging in the form of barcode patterns much in the same fashion as other print imaging operations. In addition to a machine readable pattern, many barcodes have printed next to the barcode pattern the associated alpha numeric or numeric sequence represented thereby. As in other printing operations, the sheet-form label media feeds through a printer and past a printzone. In inkjet printing operations, for example, an inkjet printhead reciprocates through a printzone and ejects ink droplets therefrom according to a print job or target print imaging, e.g., to produce barcodes throughout the array or sheet of labels passing through the printer.

In this respect, barcode printing on sheet-form labels follows other printing methods and printing operations including movement of both media and an inkjet printhead through a printzone. Coordinated positioning of the media and the inkjet printhead according to programmed control circuitry accomplishes a desired overall result, e.g., a sheet of barcode-bearing labels. In this regard, barcode label production can be accomplished using general-purpose or common printing devices, e.g., an inkjet printer mechanism also capable of providing other printing operation services. This ability to produce barcodes using a common printer mechanism with other general-purpose printing capabilities, finds challenge in mass production of barcode labels. In other words, even though barcodes can be produced on common printer mechanisms having other uses, efficient mass production of barcodes is not readily achieved. Moreover, for small batch usages, requiring less than a full sheet of labels, either the balance of the sheet is left blank, wasting media, or different bar codes are placed on the same sheet, leaving open the possibility for confusion and mistakes when applying the labels. Furthermore, when using a general purpose printer, there is the inconvenience of having to replace the normal media, such as plain paper or letterhead, with the label sheet(s), and after printing the barcodes, to reinstall the normal media.

General-purpose printers do not provide, therefore, a most desirable choice when producing barcode labels. Barcode labels when produced in great volume place particular value on efficiency. Some expensive printing devices are especially designed for barcode label printing. Yet, not all applications or users have sufficient need for mass production of barcode labels to justify access to or ownership of such dedicated barcode label-making printing devices.

SUMMARY OF THE INVENTION

Barcodes can be produced by feeding reel-stock media and receiving a drive signal from a printing device. The media receives, exterior of the printing device, print imaging as a barcode pattern or barcode indicia corresponding to the drive signal. Barcode-bearing media is thereby produced externally of the printing device but making use of the printing device resources.

The subject matter of the present invention is particularly pointed out and distinctly claimed in the concluding portion of this specification. The organization and method of operation of an embodiment of the invention may be understood by reference to the following description taken with the accompanying drawings.

DETAILED DESCRIPTION

Figure 1:
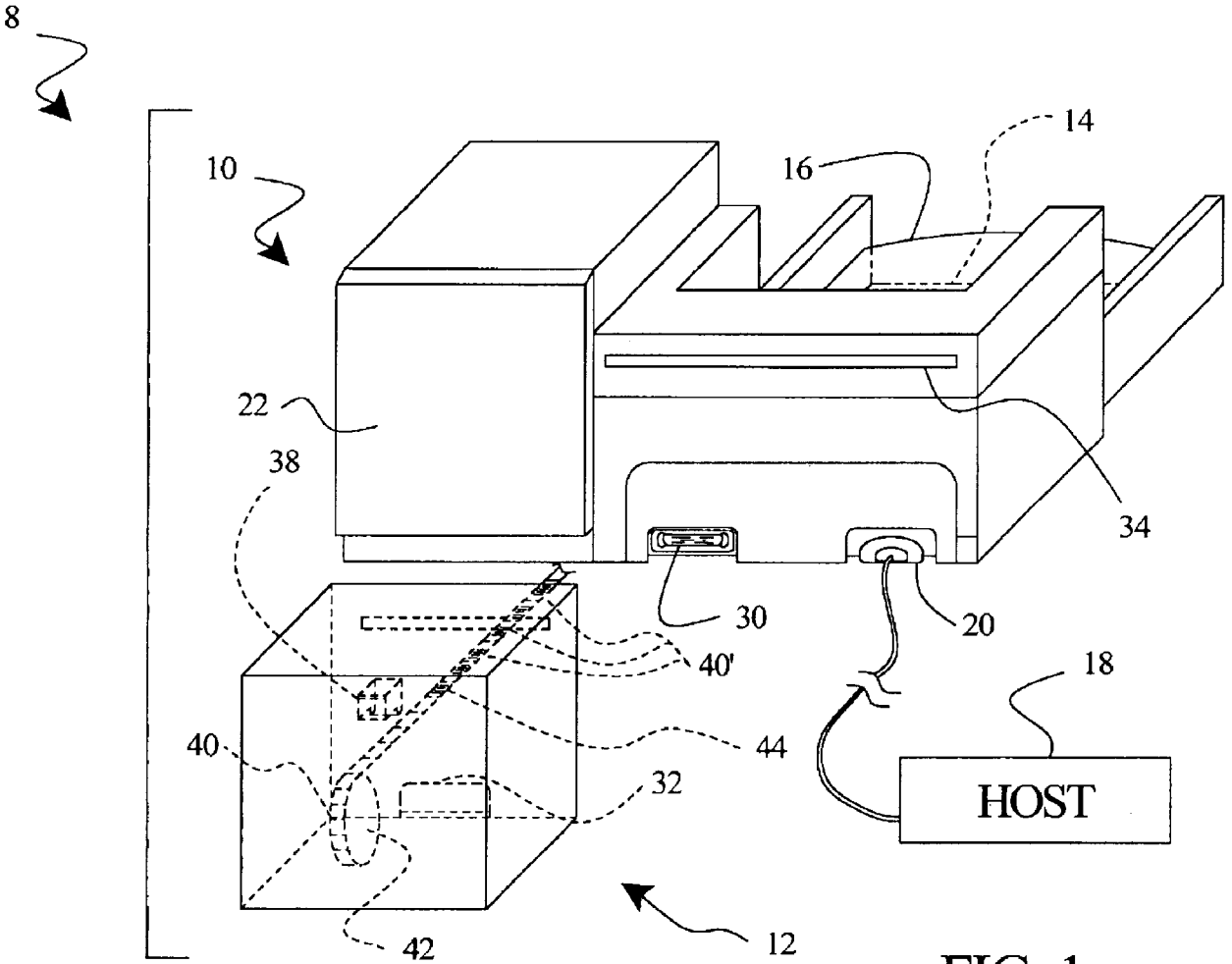
FIG. 1 is a partially schematic, perspective view of an apparatus including a printer and a barcode printing module according to an embodiment of the present invention.

FIG. 1 illustrates an embodiment of an apparatus 8 comprising a printing unit, here illustrated as an inkjet printer 10 and a barcode printing module 12 here also illustrated as an inkjet printing mechanism. Printer 10 operates as a general-purpose printer mechanism capable of applying print imaging to a variety of media, e.g., sheet-form media, as collected from a source media tray 14 and transported through printer 10 by means of media transport mechanisms (not shown in FIG. 1) past a printing device, such as a reciprocating inkjet cartridge and printhead (not shown in FIG. 1), and output at an output tray 16 of printer 10. Thus, according to this particular embodiment, a printer, e.g., printer 10, having general-purpose capabilities corresponding to other common printing devices may be modified in minor fashion to allow adaptation in support of operations including coordinated printing operations with a barcode module 12 as described more fully hereafter.

Accordingly, printer 10 may be provided and used as a general-purpose printing device. A, host device 18, e.g., a personal computer, computer network, or other controller submits a print job to printer 10 at an input electrical interface 20 of printer 10. As may be appreciated, however, interface 18 may be bi-directional and may be implemented by a variety of communication methods and protocols, e.g., by cable connection including parallel and serial (RS232 and USB) or by radio frequency or by optical-based communication devices such as an infrared port. Interface 20 may support bi-directional communication with, for example, host device 18, but generally operates to receive print jobs as input. Print jobs submitted by host device 18 for input at interface 20 direct printer 10 to render print imaging on media. As described more fully hereafter, such media may include media taken from input tray 14 or may include reel 42 barcode media taken from module 12 in production of barcode labels 40' according to this particular embodiment of the present invention.

Figure 5:
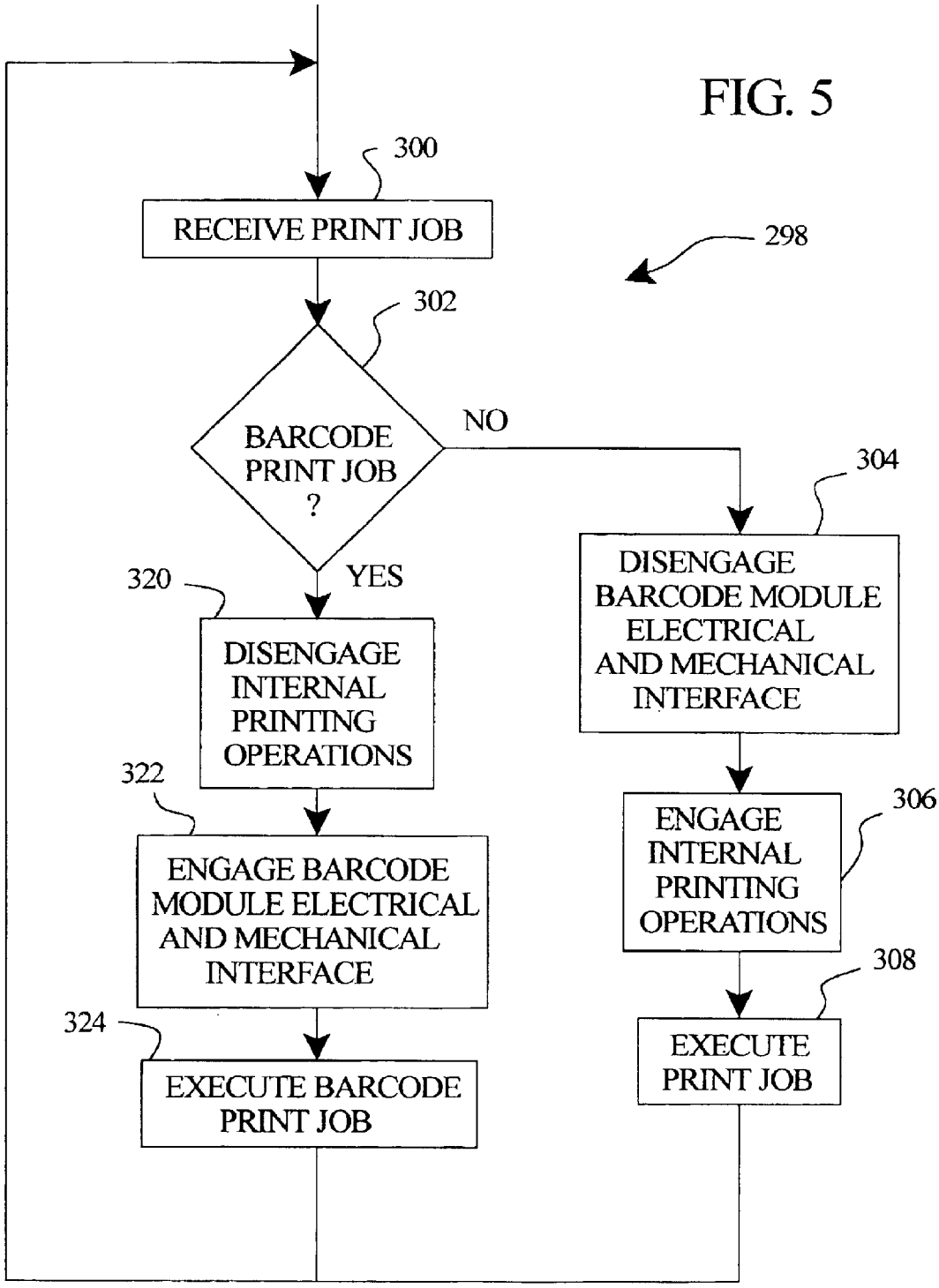
FIGS. 5 and 6 are flow charts illustrating alternative embodiments of control methods useful in operating a barcode module in cooperation with a printer.
Figure 6:
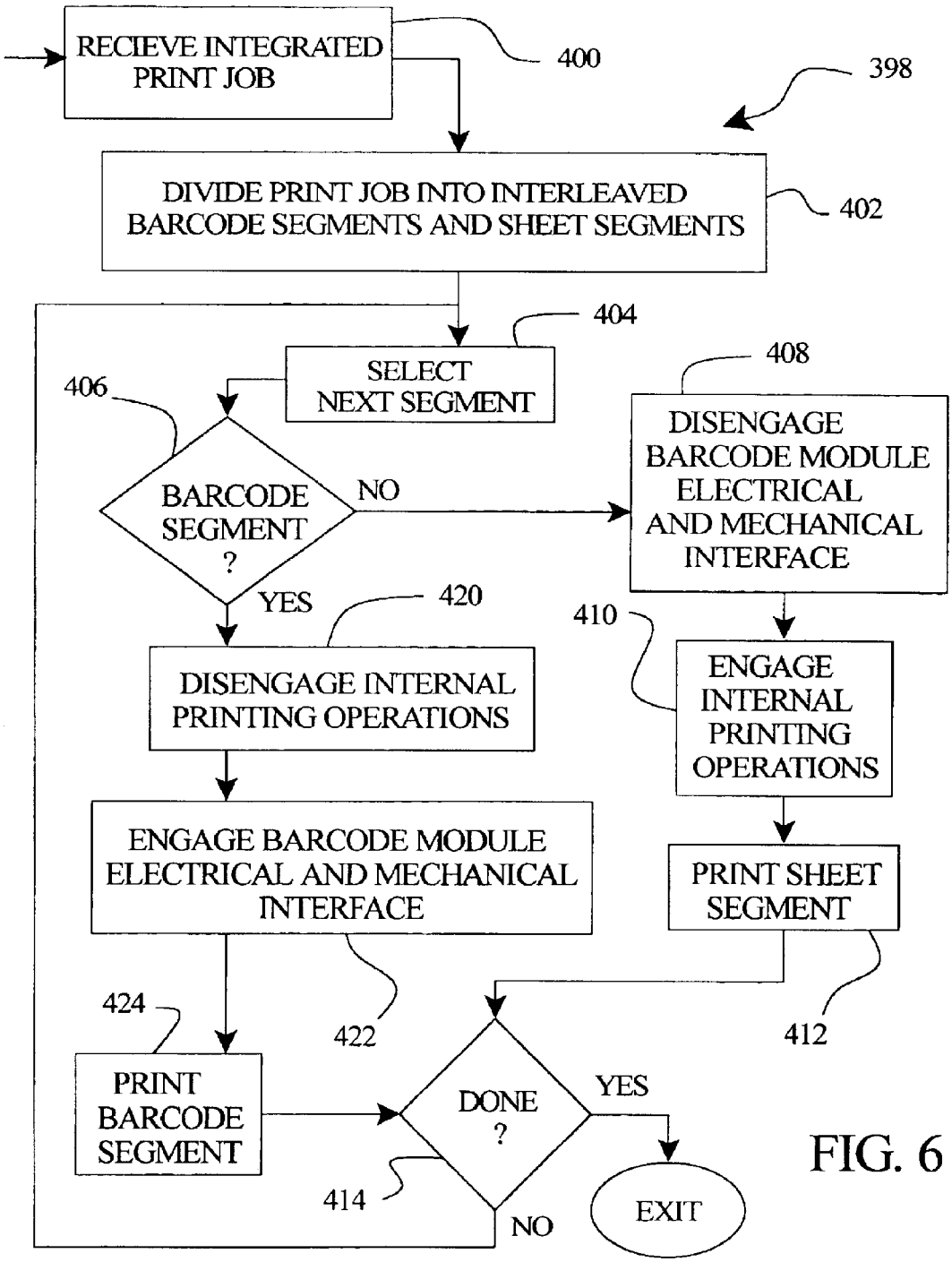

Printer 10 includes a control 22, e.g., electric control circuitry capable of interacting with a host 18 by way of interface 20 for receiving print jobs and executing print jobs. In addition, control 22 may be used as described more fully hereafter for interacting with and directing printing operations within module 12. For example, FIGS. 5 and 6 illustrate printing operations conducted under the direction of control 22.

When a user wishes to produce barcode labels 40' in significant quantity, or in any quantity, printer 10 may be employed including coordinated operation with module 12 to efficiently produce barcode labels 40' according to this particular embodiment of the present invention. A user thereby enjoys the general-purpose functions provided by printer 10, but also enjoys, when needed, use of printer 10 to provide resources in support of barcode label production according to this particular embodiment of the present invention. As such, the user need not purchase or obtain access to expensive, specialized or dedicated barcode producing equipment, but rather can employ printer 10 in support of such applications as described herein.

In accordance with the particular embodiment of the present invention illustrated herein, printer 10 can be modified in minor fashion, e.g., relative to a general-purpose printer, to support enhanced operation, e.g., barcode production in coordination with module 12. Printer 10 includes an electrical output interface 30 adapted for interaction with an electrical input interface 32 of module 12. Interface 30 may include bi-directional communication with printer 10 exchanging, for example, command and status dialog, but generally operates to provide as output barcode-related print jobs including inkjet cartridge drive signals and associated commands for operation of module 12. Module 12 could communicate to printer 10, and ultimately to host 18 by way of printer 10, information including a quantity of output produced by module 12, media status condition such as media jammed or media empty signals, additional operational status of module 12, including, as will be discussed more fully hereafter, status of an ink dispensing device therein. In other words, interface 30 of printer 10 mates with interface 32 of module 12 whereby printer 10 directs printing operations within module 12 as described more fully hereafter. More particularly, and according to one embodiment of the invention, module 12 relies on certain resources, e.g., electronics, mechanics, firmware, and drivers of a separate printer, e.g., inkjet printer 10, to support barcode printing operations. By leveraging these resources, module 12 produces barcodes at substantially minimal additional cost beyond that of printer 10. In one embodiment, for example, drive signals directly applicable to an inkjet cartridge may be provided at interface 30 of printer 10 for direct application to inkjet cartridge 38 of module 12.

Printer 10 also includes a rear media input slot 34, which may have other uses, such as an input for printing on very stiff media, or for transporting media to/from an auxiliary duplexing module, for instance, as shown in U.S. Pat. No. 6,167,231. According to one aspect of the present invention, barcode media originating in module 12 can be fed through slot 34 and pulled by internal media transport mechanisms of printer 10, e.g., pulled from module 12 and through printer 10, for presentation at output tray 16 of printer 10.

According to this particular embodiment of the present invention, printer 10 drives an inkjet cartridge 38 located outside printer 10 and within module 12. Printer 10 includes within it an inkjet cartridge 56 (FIG. 2) which may be provided as a reciprocating or scanning inkjet cartridge for conducting printing operations within printer 10. It will be understood, therefore, that printer 10 includes drive circuitry, e.g., control 22, suitable for applying a drive signal directly to inkjet cartridge 56 of printer 10. As will be discussed more fully hereafter, the same control electronics of printer 10 and drive signal produced within printer 10 may be applied externally of printer 10 by way of interface 30 and interface 32 to cartridge 38 of module 12. Cartridge 38 within module 12 applies barcode indicia to labels 40 and thereby produces barcode-bearing labels 40' as output from module 12. Cartridge 38 may be a fixed position device, e.g., need not reciprocate within module 12 and need not require any supporting mechanical carriage or cartridge transport devices or control circuitry. For example, given suitable control capabilities at interface 30 of printer 10, a simple direct electrical connection between interface 30 and cartridge 38 may be used to directly convey drive signals appropriate for producing desired print imaging at cartridge 38. In alternative configurations, however, module 12 could be provided with internal control electronics or programming serving an intermediary or control function between cartridge 38 and interface 30 of printer 10.

Figure 2:
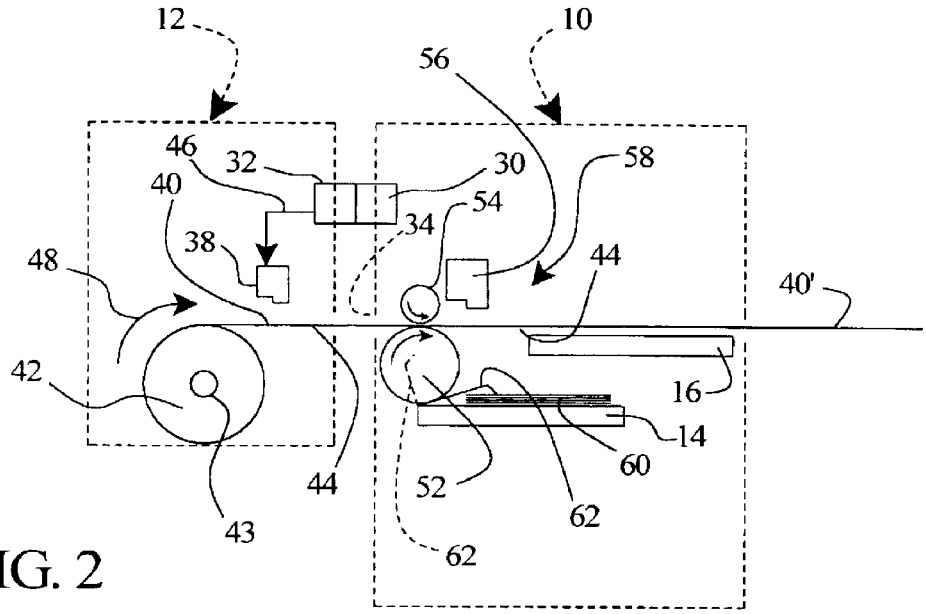
FIG. 2 is a schematic side elevational view of one form of a mechanical and electrical interface between the printer and module of FIG. 1.

In the illustrated embodiment, stationary inkjet cartridge 38 applies print imaging, e.g., barcode patterns, to a series of labels 40. Labels 40 are preferably supplied in an organized reel-form and originate from label reel 42 replaceably mounted on a supply shaft 43 (FIG. 2). Label reel 42, therefore, presents a series of blank labels 40 which may be carried on a waxy back strip of release media 44. Module 12 thereby produces a strip of barcode labels 40' which may be fed into the media feed mechanism of printer 10, e.g., at slot 34 of printer 10. The feed mechanism of printer 10 can pull media, e.g., labels 40' as carried on strip 44, from module 12 and draw the labels 40' through printer 10. Printer 10 concurrently produces appropriate firing or drive signals at electrical interface 30 for firing cartridge 38 to eject ink droplets in a selected barcode pattern on blank labels 40 to produce barcode labels 40'. Module 12, receiving inkjet cartridge firing or drive signals 46 (FIGS. 2 and 3) originating from printer 10, applies print imaging by way of cartridge 38 to labels 40 as labels 40 pass thereby in the direction of arrow 48.

Cartridge 38 may be implemented as an inkjet cartridge similar to cartridges used in, for example, printer 10. In this manner, inkjet cartridge firing or drive signal protocols directly applicable to cartridge 56 of printer 10 may be directly applicable to cartridge 38 of module 12. In other words, firing or drive signals 46 as applied to cartridge 38 of module 12 are a resource of printer 10 already available within printer 10 during normal printer operations, but provided to module 12 according to this embodiment of the present invention in production of barcode labels 40' within module 12. Inkjet cartridge interchangeability between printer 10 and module 12 also provides users with a versatile ink supply and dispensing feature requiring fewer types of supplies on hand. Generally, however, barcode module 12 could make use of the same or possibly different inks as an associated printer. Inks including visible and non-visible components, use of specialty colors, associated trade logos, non-visible inks made visible under certain light wavelengths, such as infrared or ultraviolet, also may be employed in application of print imaging in module 12 to produce labels 40'. Certain types of inks usable in module 12 can be useful for invisible barcode markings or authentication-related barcode applications.

As may be appreciated, printer 10 operation can be modified to detect the presence of module 12 and be directed, e.g., by a host device 18 or by programming internal to printer 10, to make use of module 12 as described more fully hereafter. In other words, placing module 12 into an operating position relative to printer 10 can invoke or make available modified operation of printer 10 to suspend, for example, normal sheet printing operations and execute printing operations associated with use of module 12.

Thus, module 12 produces in a given printer operation, e.g., print job, a series of barcode labels 40' in a strip-form and in number limited by the size of reel 42. In other words, if desired an entire reel 42 may be processed in a given printing operation to produce a number of barcode labels 40' corresponding to the number of labels provided on a given reel 42. A single print job could, of course, result in producing multiple reels 42 bearing a set of barcode patterns thereon. As may be appreciated, given appropriate control and status exchange between printer 10 and module 12, printing operations at module 12 can be suspended upon exhausting a reel 42 to allow replenishment of media, e.g., mounting a fresh reel 42 in module 12. In this respect, module 12 supports mass production of barcode labels 40' when a significant number of labels are provided on a given reel 42. A reel-form media, e.g., reel 42, supports a significant printing operation resulting in output corresponding to a large volume of barcode labels 40' if desired. A long strip of barcode-bearing labels 40' taken from module 12 may also be collected in roll-form for subsequent use, e.g., barcode label dispensing devices making use of a reel-form media similar to reel 42 media but with barcode patterns applied thereto. Advantage lies also in an ability to produce a limited number of barcode labels, e.g., one, several, or any number of barcode labels by use of less than an entire reel 42, while avoiding waste and possible application confusion experienced with sheet-label media. In this respect, module 12 supports not only mass production of barcode labels but also production of as few as one barcode label in a given printing operation.

Inkjet cartridge 38 can be fixed in position. Cartridge 38 may be a single ink-dispensing cartridge or may be multiple ink-dispensing cartridges 38 banked together in a stationary, fixed position to achieve the desired barcode height, or to apply different colors of inks, or waterproof over-coating formulations. Power need not be devoted to reciprocating an inkjet cartridge carriage and no current spikes associated with sudden activation of carriage motors occur. Printer 10 needs sufficient energy to pull reel 42 media from module 12 and to drive cartridge 38. Furthermore, it may be noted that reel 42 media moves continuously while concurrently receiving print imaging thereon. In other words, module 12 is time-efficient because media moves concurrently with application of print imaging thereto.

Module 12 provides improvement in barcode production, especially with respect to certain widths of labels 40. Inkjet technology shows an ever-increasing swath height for inkjet printheads. Swath height refers to the height of print imaging applied to media from a set of inkjet nozzles projecting ink droplets to form print imaging. Media transport direction often coincides, e.g., aligns, with the set of inkjet nozzles organized as a column. In other words, a column of inkjet nozzles is often aligned with the media transport direction. Under such an arrangement, the inkjet printhead reciprocates across a printzone while media moves therethrough in coordinated fashion to apply swath-by-swath print imaging. Under the illustrated particular embodiment of the present invention, however, inkjet cartridge 38 can be fixed in a stationary position and a column of inkjet nozzles can be oriented transversely to a media transport direction. Accordingly, an inkjet cartridge 38 providing a swath height corresponding to a width 50 (FIG. 3), i.e., lateral, dimension of labels 40, provides opportunity to print a complete label 40' in one swath. In other words, a barcode pattern may be applied as print imaging to a blank label 40 in a single pass of the label 40 past cartridge 38. In this regard, cartridge 38 acts as a page-wide-array (PWA) printhead with respect to a given range of dimension for width 50 of labels 40.

Figure 3:
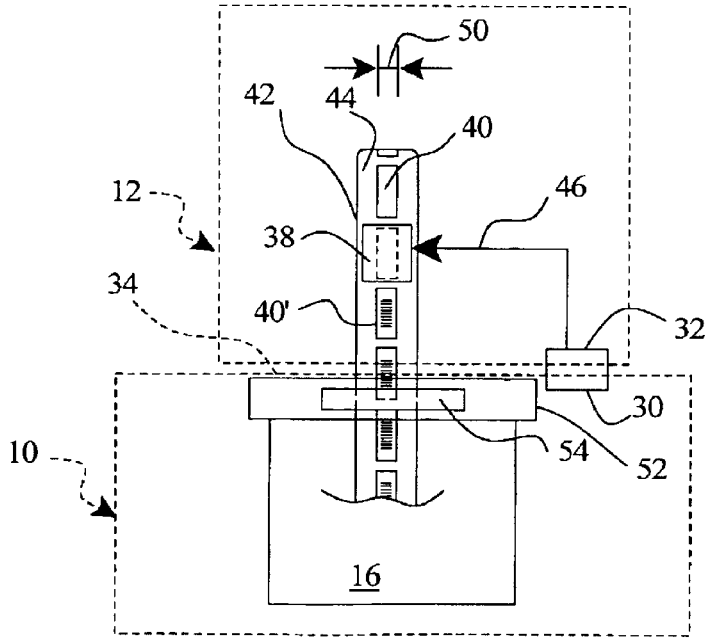
FIG. 3 is a schematic top plan view of the mechanical and electrical interface between the printer and module of FIG. 1.

FIGS. 2 and 3 illustrate schematically printer 10 and module 12 joined together for coordinated operation under a particular embodiment of the present invention. Generally, the schematic presentation in FIGS. 2 and 3 shows use of media transport features of printer 10 to pull reel 42 media therethrough. While a particular method of media transport is illustrated schematically in FIGS. 2 and 3, it will be understood that printing mechanisms, e.g., printer 10, include a variety of media transport devices and arrangements. FIGS. 2 and 3 illustrate, therefore, in schematic fashion access to such variety of media transport mechanisms to pull reel 42 media through printer 10. The particular embodiment shown, therefore, represents access to media transport resources of FIG. 10 for the purpose of pulling reel 42 media therethrough, and not a particular structure or operation of media transport within printer 10. In FIG. 2, printer 10 includes an input tray 14 and output tray 16. Input tray 14 normally holds a stack of sheet-form media therein such as plain paper or letterhead. A shaft or rollers or tires 52 (hereafter roller 52) and shaft or rollers or tires 54 (hereafter roller 54) contribute to collection of media from tray 14 and transport thereof along a feed path including roller 52 and roller 54. Normally, printer 10 applies print imaging at its cartridge 56 and transports media along its feed path past cartridge 56 within printer 10 for application of print imaging thereon in printzone 58. In accordance with the illustrated embodiment of the present invention, however, such normal printing operations can be suspended while printer 10 interacts with module 12 in production of barcode labels 40'. For instance, the sheet supply 60 of media could simply be removed by an operator from the input tray 14, but more preferably, a blocking mechanism 62, resting between roller 52 during normal printer operation (shown in dashed lines) may be activated as shown in FIG. 2 (solid lines) to block the sheet supply 60 from being collected by roller 52. Other blocking mechanisms include a pick mechanism which lifts a paper supply into picking engagement. Module 12 may be used, therefore, when the paper supply is not lifted and not in picking engagement.

As shown in FIGS. 2 and 3, labels 40 as carried on strip 44 pass as reel 42 media between roller 52 and roller 54, e.g., at a nip therebetween. As rollers 52 and 54 rotate in opposite directions, counterclockwise for roller 54 and clockwise for roller 52 as seen in FIG. 2, reel 42 media is pulled from module 12 and through printer 10 for presentation at output tray 16 of printer 10. As noted above, the illustration of rollers 52 and 54 pulling reel 42 media through printer 10 is a schematic illustration, it being understood that a variety of media transport devices and architectures may be employed to pull reel 42 media through a printing mechanism. As may be appreciated, during such operation, printer 10 can suspend normal picking of media from input tray 14, e.g., through use of blocking mechanism 62 or a paper supply lifting arrangement as discussed above.

Reel 42 media may be introduced into printer 10 by opening slot 34 and inserting a leading edge of reel 42 media at the nip of roller 52 and roller 54. Advancing reel 42 media forward and through printer 10 along its media transport path may occur by activating roller 52 and roller 54 in known manner for coordinating printing operation at cartridge 38 with reel 42 media advance. A leading section of reel 42 media may be provided as a "leader" for first introducing reel 42 media into printer 10 without wasting an initial series of labels 40.

While illustrated herein as a single inkjet cartridge 38, it will be understood that inkjet cartridge 38 as illustrated herein may be implemented by one or more actual inkjet printing devices. Thus, reference herein to "cartridge 38" can also be taken as including multiple individual inkjet cartridges suitably organized to act cooperatively in producing print imaging or otherwise dispense liquid components as described herein. Generally, such multiple cartridges 38 may be used to dispense different liquid elements, e.g., ink components and/or coating components, but generally would be ganged together to provide a sufficiently large swath height to cover the lateral width 50 of labels 40 passing thereby. In other words, to achieve a sufficiently wide swath, e.g., wide enough for a given barcode label-making printing operation, several inkjet printing cartridges may be suitably positioned and driven to act in coordination as a virtual cartridge 38 of sufficient swath height to produce barcode labels as described herein. As may be appreciated, such multiple inkjet cartridges can be fixed in position and printing operations can be suitably formatted according to particular application to take into account the relative position of such multiple inkjet print cartridges to produce the desired output. In other words, print imaging data applied to multiple inkjet printheads may be suitably formatted taking into account the relative position of such multiple inkjet printheads to produce a sufficient swath height for application of barcode print imaging through the lateral dimension of labels 40.

Thus, a substantially general-purpose printer may be used to efficiently and conveniently produce in mass volume barcode labels even though not dedicated for mass production of barcode labels. A module 12 makes use of one or more fixed inkjet cartridges receiving a drive signal 46 from the printer 10. The printer contributes its feed mechanism, e.g., rollers 52 and 54, to pull from module 12 printed output, i.e., barcode-bearing labels 40'. The module 12 itself is of simple design and structure. More particularly, a fixed inkjet cartridge receives directly a drive signal 46 from the printer 10. Little or no motive force need be applied to move media through module 12 when a printer operating in coordination therewith pulls from the module the reel-form media and thereby moves the media past the print imaging device within the module. Overall, efficient power consumption result because the inkjet cartridge 38 can be fixed and media transport produces a substantially uniform energy drain. In accordance with the illustrated embodiment of the present invention, therefore, an otherwise substantially general-purpose printer may be used to produce mass quantities of barcode labels in an energy-efficient and convenient manner preferably without disruption the normal supply 60 of sheet media in the input tray 14. Persons having need for production of barcodes can obtain a relatively inexpensive solution, i.e., purchase a module as described herein for operation in conjunction with a printer having minor modifications for operating in conjunction with a barcode module.

The embodiment illustrated in FIGS. 1–3 is a form of barcode module having little or no substantial internal electronics or mechanical features due to its ability to obtain resources from printer 10 in implementation of barcode label production as described above. Generally, for the embodiment illustrated in FIGS. 1–3 when coupled to printer 10, e.g., with reel 42 media suitably engaged by printer 10 media transport apparatus, normal printing operations within printer 10 are suspended. Alternative embodiments may be provided which include modified media feed or transport features of printer 10 capable of concurrently accommodating both reel 42 media and sheet-form media.

Figure 7:
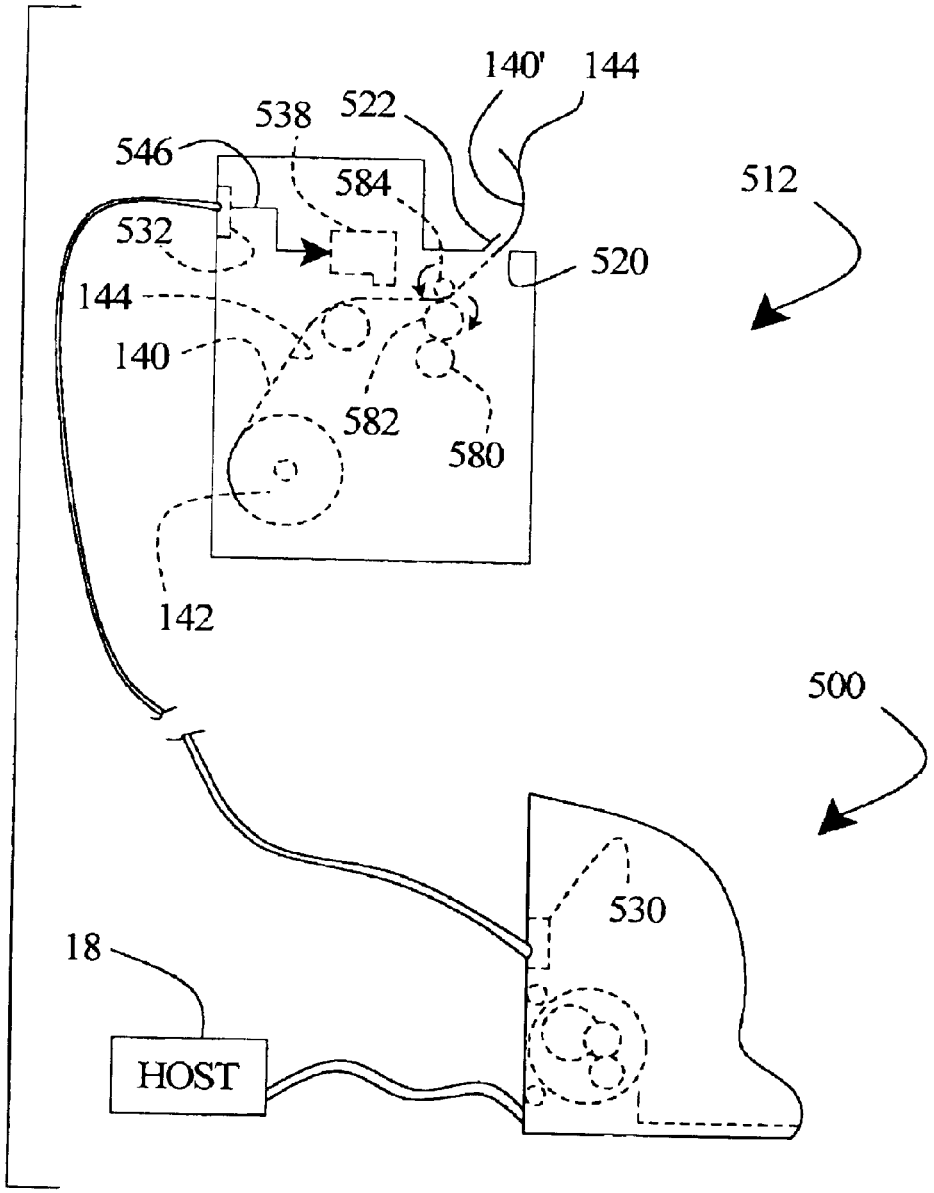
FIG. 7 illustrates another alternative apparatus combining a printer and a barcode module.

Coordinated printing operations integrating sheet-form output as well as strip-form barcode label output can be accomplished. For example, the embodiments of FIGS. 4 and 7 illustrate coordinated media handling to allow concurrent or interleaved sheet-form media output and strip-form barcode label output as described more fully hereafter.

Figure 4:
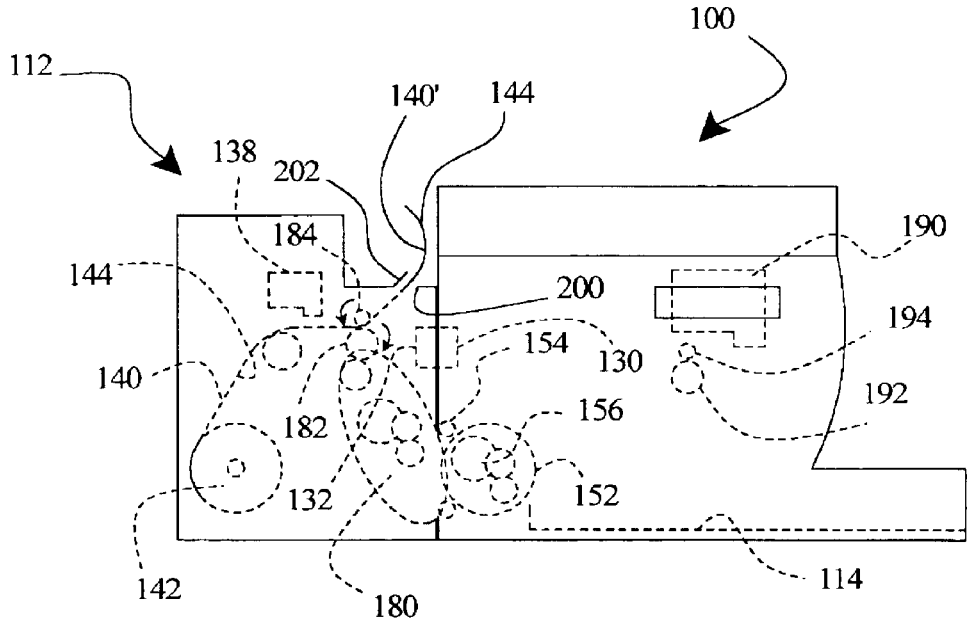
FIG. 4 is a side elevational view of an alternative embodiment of an apparatus comprising a barcode printing module coupled to a printer.

FIG. 4 illustrates schematically an alternative embodiment including a substantially general-purpose printer 100, in this particular example provided as an inkjet printing mechanism. Printer 100 includes, for example, an interface (not shown) for receiving print jobs from, for example, a host device similar to host device 18 as coupled to printer 10 of FIG. 1. Printer 100 operates in conjunction with a barcode module 112 attached thereto. Many of the advantages discussed above in relation to module 12 are equally applicable to module 112. In addition, however, module 112 may be integrated into printer 100 operation without significantly affecting normal printing operations when module 112 is attached to printer 100. In this particular embodiment of the present invention, module 112 includes a fixed inkjet cartridge 138 therein and a reel 142, e.g., media holding barcode labels 140 and backsheet 144. Module 112 includes a selectively engageable transmission 180 mechanically coupled, e.g., geared, to roller 152 of printer 100.

The exact arrangement of transmission 180 may vary depending on the particular implementation, but may include a meshing gear assembly for smooth media flow, a ratcheting mechanism for advancing reel 142 media label-by-label, or other coupling mechanisms capable of design by those skilled in the art, for instance using the transmission shown in U.S. Pat. No. 6,167,231 for a duplexing module which is removably attached to a printer for optional duplex (two-sided) printing operation. A carriage portion (not shown) of printer 100 may be used to activate and deactivate the transmission 180, or a solenoid or other mechanical selection device. In other words, transmission 180 is selectively operable whereby transmission 180 engages or disengages reel 142 media feeding action within module 112. More particularly, transmission 180 selectively rotates a roller 182 of module 112. A pinch roller 184 establishes a nip relative to roller 182 and reel 142 media passes therebetween. With transmission 180 engaged, motive force taken from printer 100 drives roller 182 and thereby propels reel 142 media past inkjet cartridge 138 and out an output slot 200 of module 112. When not engaged, shaft 182 does not rotate and reel 142 media remains stationary within module 112.

Printer 100 thereby provides a mechanical motive force by way of the selectively disengageable transmission 180 to transport labels 140 past fixed inkjet cartridge 138 of module 112 and thereby produce barcode-bearing labels 140'. In this particular embodiment, however, the resulting output, i.e., reel 142 media including printed labels 140' bearing barcode indicia or pattern thereon, exits module 112 at an output such as slot 200 thereof. In some implementations it may be desirable to include a take-up reel for collecting the strip of barcode labels 140' in an easy to transport or dispense fashion. In other words, and as distinguished from the prior-described embodiment of the invention, the associated general-purpose printer need not transport barcode media therethrough. Output slot 200 may be provided with a serrated edge or other such cutting device 202 for severing a selected segment of, e.g., one or more, labels 140' and backsheet 144 from module 112. In other words, a particular printing operation will produce a given number of barcode labels 140' appearing as a strip of labels 140' at output slot 200 and a user may employ serrated edge 202 or other cutting device to separate this strip of barcode label 140' output from module 112.

As may be appreciated, printer 100 receives print jobs from a host device, such as host 18, in similar fashion to that illustrated with respect to printer 10. In other words, printer 100 includes an electrical interface 130 similar to interface 30 of printer 10. Similarly, module 112 includes an interface 132 compatible with an interface 130 of printer 100 whereby printer 100 directs operation of module 112, e.g., provides to cartridge 138 drive or firing signals as described above for the purpose of directing operation of module 112.

Thus, barcode module 112 need not use a printer 100 media transport path for printing of barcodes. A barcode media feed path can be contained within the barcode module 112 to thereby leave free a sheet media feed path and media transport mechanisms of printer 10 for normal printing operations, e.g., as originating from input tray 114 and passing by inkjet cartridge 190 of printer 100 by way of the normal feed path including pick rollers 152, 154, and drive rollers 192, and 194, for instance, as is known in the art.

Module 112 operates to disengage the transmission interconnect 180 for removing and replacing reel 142 when not in use. In addition, module 112 can include in conjunction with disconnection of transmission interconnect 180, cartridge 138 capping devices to prevent an undesirable effect of nonuse relative to cartridge 138, e.g., to temporarily seal an orifice plate (not shown) of cartridge 138 when inactive as is known in the inkjet technology arts, as well as to conduct wiping, priming, or purging operations when necessary. Such servicing mechanisms are widely varied and known and may optionally form an embodiment of a barcode module 112 as described herein. Similar capping and servicing arrangements may be incorporated into module 12 as discussed above.

FIG. 5 illustrates one form of a general modification of a printer control method or process 298 relative to use of module 112. In FIG. 5, a printer, e.g., printer 100, receives a print job, e.g., from a host device 18. Thus, in block 300 a print job is received and includes an indication as to whether or not the print job involves use of a barcode module, e.g., use of module 112. In decision block 302, the printer, e.g., printer 100, determines whether the print job requires use of an associated barcode module, e.g., module 112. If the print job does not include use of a barcode module, then processing branches at block 302 to block 304 where the printer, e.g., printer 100, disengages a barcode module electrical and mechanical interface and continues to block 306 where it engages internal printing operations, e.g., normal printing operations involving media taken from, for example, an input tray 114. Continuing to block 308, the printer executes and prints the requested print job and returns to block 300 to receive a next print job, e.g., stands ready for further printing operations including either barcode or sheet-fed operations.

Returning to decision block 302, if the print job received in block 300 does involve use of a barcode module, e.g., module 112, processing branches at block 302 to block 320 where the printer, e.g., printer 100, disengages its internal printing operations and, in block 322, engages its barcode module 112 electrical and mechanical interface. Continuing to block 324, the printer, e.g., printer 100, executes the barcode print job and prints the barcode labels 140' including application of drive or firing signals to an external printing device, e.g., cartridge 138, to apply print imaging representing barcode indicia on the labels 140'. Block 322 may include commands applied to module 112 to engage a mechanical coupling between transmission 180 of module 112 and a roller 156 of printer 100. Accordingly, as roller 156 rotates and in turn rotates a drive gear 156, transmission 180 receives motive force from gear 156 and in turn advances reel 142 media in executing the barcode print job in block 324.

The method of operation shown in FIG. 5 generally separates, at least at the level of operation within module 12, barcode printing operations and non-barcode printing operations. Programming including print job formatting executed by a host device, e.g., host device 18, may include coordinated but separate submission of barcode print jobs and non-barcode print jobs to a combined printer and barcode module which thereafter treats such separate print jobs as indicated in FIG. 5. The resulting output, however, may include coordinated production of barcode labels 140' associated with a barcode-bearing sheet-form media. For example, host device 18 may submit a barcode print job and a non-barcode print job having an association or relation therebetween. Submitting separate but related print jobs for print imaging as indicated in FIG. 5 will result in two separate but related outputs from the combined apparatus of printer 10 and module 112.

FIG. 6 illustrates modified operation of an apparatus including a printing device and a barcode module, but receiving an integrated print job, e.g., a print job including instructions for producing barcode labels 140' and related output, e.g., sheet-form output from the printing device. In FIG. 6, a method 398 of coordinated sheet media output and barcode label strip-form output is shown. An integrated print job is received in block 400. An integrated print job, for example, directs the apparatus of, for example, printer 10 and module 112 to produce both sheet-form media output and strip-form barcode labels 140' output. Such integrated print jobs might require association between the sheet-form output and the strip-form label 140' output. In block 402, the integrated print job is divided into interleaved barcode segments and sheet segments. In block 404, a next segment is selected, i.e., a next (or first) segment in the set of barcode segments and sheet segments is selected for rendering. In decision block 406, if the current segment is not a barcode segment, i.e., is a sheet segment, then processing branches through block 408 where printer 100 disengages its barcode module electrical and mechanical interface. Continuing to block 410, printer 100 engages its internal printing operations and, in block 412, prints the sheet segment portion of the integrated print job. Processing then advances to decision block 414. In decision 414, if no further barcode segments or sheet segments remain, then processing exits. Otherwise, processing branches at decision block 414 and returns to block 404 where the next segment is selected. If the next segment is a barcode segment, then processing branches at decision 406 into block 420 where printer 100 disengages its internal printing operations and, in block 422, engages its barcode module electrical and mechanical interface. Continuing to block 424, the combined apparatus of printer 100 and module 112 prints the barcode segment of the integrated print job and thereafter advances to decision block 414.

Overall, the combined apparatus of printer 100 and module 112 executes the integrated print job by interleaving sheet-form printer output with strip-form barcode label 140' output. The integrated output may then be used in coordinated fashion according to a particular application, e.g., where an association exists between barcode labels produced in module 112 and sheet-form media output produced in printer 100. As may appreciated, sheet-form printer 100 output may well include barcode patterns printed thereon corresponding to or identical to barcode patterns printed by module 112 as desired and according to the integrated print job.

FIG. 7 illustrates another form of barcode module, here illustrated as module 512 cooperatively interacting with a printer 500 (shown partially in FIG. 7). Printer 500 is a substantially general purpose printer having normal interface resources, e.g., as coupled to a host device 18, and further an additional interface 530 similar to interface 30 of FIG. 1 and interface 130 of FIG. 4. Generally, interface 530 provides inkjet cartridge drive signals 546 directly applicable to an inkjet cartridge 538 of module 512 by way of interface 532 of module 512. In addition, interface 530 provides power and control signals applicable to a drive motor 580 of module 512. Motor 580 rotates a drive roller 582 forming a nip relative to a pinch roller 584. A reel 142 including labels 140 and waxy backsheet 144 mounts rotatably within module 512. Reel 142 media passes by inkjet cartridge 538 and through the nip of rollers 582 and 584. In this manner, printer 500 directs operation of module 512 by controlling motor 580, e.g., to controllably advance reel 142 media past cartridge 538. Furthermore, printer 500 provides inkjet cartridge firing signals 546 directly to cartridge 538 as discussed hereinabove relative to cartridge 38 and cartridge 138. Reel 142 media exits module 512 at a slot 520 including a serrated edge 522 as described above for module 112. Module 512 makes use of printer 500 resources, e.g., inkjet cartridge firing signals, but need not be mechanically coupled to printer 500 by virtue of module 512 including internal media transport resources, e.g., motor 580 and rollers 582 and 584. Module 512 can be operated in similar fashion to module 112 in that integrated print jobs, e.g., including both barcode segments and sheet-form segments can be executed by a combined apparatus including printer 500 and module 512 as described above and illustrated in FIGS. 5 and 6. The apparatus of FIG. 7, however, has an ability to concurrently apply print imaging in printer 500 and in module 512.

While illustrated as an accessory module for an inkjet printer herein, the barcode module need not be coupled to an inkjet printer device as shown herein. Generally, the barcode module proposed herein takes advantage of certain resources provided by a printing device to allow that printing device to support barcode label production. For example, drive signals may be taken from a variety of general purpose printers and applied to a printing device of the barcode module to produce barcode labels. Additional resources may include mechanical motive force taken from a general-purpose printer for mechanical operation of media transport elements within a barcode module. Coupling a barcode module using an inkjet cartridge therein to an inkjet printer, however, has the advantage of making use of preexisting cartridge firing signals which may be directed externally of the inkjet printer and into the barcode module for direct application to an inkjet cartridge therein.

While illustrated herein coupled to a substantially general-purpose printing mechanism, e.g., an inkjet printer, a barcode module as proposed herein may be applied to a variety of other image-producing or printing devices including, for example but not limited to, facsimile machines, plotters, photo printers, fabric printers, and the like where resources thereof, e.g., mechanical or drive signal resources, may be applied to production of barcode labels as described herein. Furthermore, a variety of image-producing or printing devices benefit by associating output with barcode patterns. For example, a barcode rendition of a phone number may be presented in use of a facsimile machine indicating faxes sent/received by means of barcode indicia. Plotters or photo printers benefit by including in output barcode indicia associated with a client or customer information or for pricing or stocking information relative to the output. Fabric printing devices can incorporate barcode indicia into its output to identify a particular fabric pattern, price, routing or such information by barcode indicia. Thus, a barcode module used in conjunction with a printing device, e.g., printer, fax machine, plotter, photo printer, fabric printer, and the like benefits by use of coordinated operation with a barcode module whereby not only application of barcodes to normal printing device output may be accomplished but also to a separate barcode label, e.g., a label 40' or 140', bearing identical or related barcode indicia produced in conjunction with producing the normal printing device output.

It will be appreciated that the present invention is not restricted to any particular embodiment described or illustrated herein, and that variations may be made without departing from the scope of the invention as found in the appended claims and equivalents thereof.

What is claimed is:

1. A method of producing a barcode, said method comprising;

feeding reel-stock media within a printing module;

receiving a drive signal from a printing device external to the printing module; and applying to said media, exterior of said printing device and within the printing module, print imaging as a barcode pattern corresponding to said drive signal.

2. A method according to claim 1 wherein said printing device is a printing mechanism.

3. A method according to claim 1 wherein said barcode pattern includes a series of lines.

4. A method according to claim 3 wherein said series of lines are substantially parallel and lie substantially transverse to a direction of feeding said reel-stock media.

5. A method according to claim 1 wherein applying including application of print imaging by an inkjet cartridge operating exteriorly of said printing device.

6. A method according to claim 5 wherein said inkjet cartridge is fixed in position.

7. A method according to claim 5 wherein said inkjet cartridge includes a nozzle column, said column being oriented transversely relative to a direction of feeding said reel-stock media.

8. A method according to claim 1 wherein said feeding reel-stock media includes pulling said reel-stock media into said printing device.

9. A method according to claim 8 wherein said pulling includes application of motive force to said reel-stock media by media transport mechanisms of said printing device.

10. A method according to claim 1 wherein said feeding includes application of motive force by a feed mechanism exterior of said printing device.

11. A method according to claim 10 wherein said feeding further comprises driving said feed mechanism by mechanically coupling said printing device thereto.

12. A method according to claim 10 including providing energy from the printing device to a drive motor for controllably feeding said reel-stock media.

13. A method according to claim 1 wherein said method further includes attaching a barcode module to said printing device and said receiving a drive signal and said applying occurs within said barcode module.

14. A method according to claim 13 wherein said module includes a media feed mechanism moving said reel-stock media past a printing element of said module and to an output of said module.

15. A method according to claim 13 wherein said printing device pulls said media from said module.

16. A method according to claim 13 wherein said barcode module includes therein a media feed mechanism, said media feed mechanism including a drive motor, said printing device providing electrical energy to said drive motor.

17. A method according to claim 1 wherein said method further comprises:

receiving a print job at said printing device;

determining if said print job requests use of a barcode module attached to said printing device; and executing said print job when said print job requests use of said barcode module by directing said drive signal to said barcode module according to said print job.

18. A method according to claim 17 wherein said method includes disengaging internal printing operations of said printing device when executing said print job.

19. A method according to claim 1 including applying reel-stock media to a reel support coupled to a printing module.

20. A barcode printing module for coupling to a printing mechanism located externally from the module and which generates a drive signal, comprising:

a reel-stock media feed mechanism configured to provide a reel-stock media feed path from a source of reel stock carried by the barcode printing module;

a printing element positioned adjacent said feed path, said printing element applying print imaging to said media in response to said drive signal when coupled to said printing mechanism; and a drive signal interface which receives said drive signal from said printing mechanism and applies said drive signal to said printing element.

21. A module according to claim 20 wherein said barcode printing module is adapted for mounting to an inkjet printer serving as said printing mechanism supplying said drive signal.

22. A module according to claim 20 wherein said printing element is an inkjet cartridge.

23. A module according to claim 20 wherein said module mechanically couples to said printing mechanism and thereby transports said reel-stock media along said reel-stock media feed path.

24. A module according to claim 23 wherein said printing mechanism and said module as mechanically coupled together include means for pulling said reel-stock media from said module into said printing mechanism.

25. A module according to claim 23 wherein said printing mechanism and said module as mechanically coupled together include receiving mechanical motive force from said printer by mechanical interface therewith and applying said motive force to draw said media along said reel-stock media feed path, said motive force being applied to said media within said module.

26. A module according to claim 20 wherein said barcode printing module includes an electrical and mechanical interface coupled to said printing mechanism whereby said barcode printer module receives said drive signal at said interface and receives from said printing mechanism motive force for urging said reel-stock media along said reel-stock media feed path.

27. A module according to claim 20 wherein the reel-stock media feed mechanism includes a reel support configured as part of the module.

28. An apparatus, comprising:

a printer including a media feed path, said media feed path originating at an input and terminating at an output of said printer, said printer providing a first interface providing an inkjet cartridge drive signal; and a barcode printing module coupled to said printer, said barcode printing module including a reel-stock feed path and an inkjet cartridge positioned adjacent thereto for application of print imaging, said module including a second interface which couples to said first interface to receive said inkjet cartridge drive signal, said second interface being coupled to said inkjet cartridge for production of print imaging according to said drive signal.

29. A barcode-producing device, comprising:

means for supporting label media provided in reel-form and carried by the barcode-producing device;

means for transporting said media past a printzone;

means for printing located adjacent said printzone to apply print imaging to said media moving therepast; and means for receiving a drive signal from a printing device external to the barcode-producing device and applying said drive signal to said means for printing to apply print imaging to said media moving therepast.

30. A device according to claim 29 wherein said means for transporting said media past a printzone includes a mechanical interface receiving a motive force external of said barcode-producing device.

31. A device according to claim 29 wherein said means for transporting said media include a media transport mechanism comprising an electric motor, said electric motor receiving control and power externally of said barcode-producing device.

32. A device according to claim 29 wherein said means for printing comprises an inkjet cartridge.

33. A device according to claim 32 wherein said inkjet cartridge includes a column of ink-dispensing nozzles, said column lying transverse to a direction of movement of said media past said printzone.

34. A device according to claim 29 wherein the device includes a housing and wherein the means for supporting label media provided in reel form is within the housing.

35. A printer comprising:

a first communication interface which receives print jobs thereat; and a second communication interface which provides an inkjet cartridge drive signal thereat, said drive signal being activated by said printer in response to at least one of said print jobs requesting use of a barcode module coupled to said second interface, wherein the printer is configured to mechanically couple to media extending from the barcode module so as to draw the media through the barcode module.

36. A printer according to claim 35 wherein said first communication interface is an electrical interface.

37. A printer according to claim 35 wherein said second communication interface is an electrical interface.

38. A printer according to claim 35 further comprising the barcode module and wherein said printer and said barcode module as attached thereto mechanically interact, said printer providing motive force to media within said barcode module.

39. A printing according to claim 38 wherein said barcode module mechanically couples to said printer to receive motive force therefrom, said barcode module transferring said motive force to said media in transporting said media through said barcode module.

40. A printer according to claim 38 wherein said printer mechanically couples to media extending from said barcode module, said printer applying motive force to said media extending from said barcode module and thereby drawing said media through said barcode module.

41. A method of producing a barcode, said method comprising:

feeding reel-stock media;

receiving a drive signal from a printing device; and applying to said media, exterior of said printing device, print imaging as a barcode pattern corresponding to said drive signal wherein said feeding includes application of motive force by a feed mechanism exterior of said printing device and wherein said feeding further comprises driving said feed mechanism by mechanically coupling said printing device thereto.

42. A method of producing a barcode, said method comprising:

feeding reel-stock media;

receiving a drive signal from a printing device; and applying to said media, exterior of said printing device, print imaging as a barcode pattern corresponding to said drive signal, wherein said feeding includes application of motive force by a feed mechanism exterior of said printing device and wherein the method further includes providing energy to a drive motor for controllably feeding said reel-stock media.

43. A method of producing a barcode, said method comprising:

feeding reel-stock media;

receiving a drive signal from a printing device;

attaching a barcode module to said printing device and said receiving a drive signal and said applying occurs within said barcode module; and applying to said media, exterior of said printing device, print imaging as a barcode pattern corresponding to said drive signal, wherein said printing device pulls said media from said module.

44. A method of producing a barcode, said method comprising:

feeding reel-stock media;

receiving a drive signal from a printing device;

attaching a barcode module to said printing device and said receiving a drive signal and said applying occurs within said barcode module; and applying to said media, exterior of said printing device, print imaging as a barcode pattern corresponding to said drive signal, wherein said barcode module includes therein a media feed mechanism, said media feed mechanism including a drive motor, and printing device providing electrical energy to said drive motor.

45. A method of producing a barcode, said method comprising:

feeding reel-stock media;

receiving a drive signal from a printing device;

receiving a print job at said printing device;

determining if said print job requests use of a barcode module attached to said printing device;

executing said print job when said print job requests use of said barcode module by directing said drive signal to said barcode module according to said print job; said applying to said media, exterior of said printing device, print imaging as a barcode pattern corresponding to said drive signal.

46. A barcode printing module for coupling to a printing mechanism generating a drive signal, comprising:

a reel-stock media feed mechanism which provides a reel-stock media feed path;

a printing element positioned adjacent said feed path, said printing element applying print imaging to said media in response to said drive signal when coupled to said printing mechanism;

a drive signal interface which receives said drive signal from said printing mechanism and applies said drive signal to said printing device, wherein said module mechanically couples to said printing mechanism and thereby transports said reel-stock media along said reel-stock media feed path; and wherein said printing mechanism and said module as mechanically coupled together include means for pulling said reel-stock media from said module into said printing mechanism.

47. A barcode printing module for coupling to a printing mechanism generating a drive signal, comprising:

a reel-stock media feed mechanism which provides a reel-stock media feed path;

a printing element positioned adjacent said feed path, said printing element applying print imaging to said media in response to said drive signal when coupled to said printing mechanism;

a drive signal interface which receives said drive signal from said printing mechanism and applies said drive signal to said printing device, wherein said module mechanically couples to said printing mechanism and thereby transports said reel-stock media along said reel-stock media feed path; and wherein said printing mechanism and said module as mechanically coupled together include receiving mechanical motive force from said printer by mechanical interface therewith and applying said motive force to draw said media along said reel-stock media feed path, said motive force being applied to said media within said module.

48. A barcode printing module for coupling to a printing mechanism generating a drive signal, comprising:

a reel-stock media feed mechanism which provides a reel-stock media feed path;

a printing element positioned adjacent said feed paths said printing element applying print imaging to said media in response to said drive signal when coupled to said printing mechanism;

a drive signal interface which receives said drive signal from said printing mechanism and applies said drive signal to said printing element, wherein said module mechanically couples to said printing mechanism and thereby transports said reel-stock media along said reel-stock media feed path; and wherein said barcode printing module includes an electrical and mechanical interface coupled to said printing mechanism whereby said barcode printer module receives said drive signal at said interface and receives from said printing mechanism motive force for urging said reel-stock media along said reel-stock media feed path.

* * * * *

UNITED STATES PATENT AND TRADEMARK OFFICE

CERTIFICATE OF CORRECTION

PATENT NO. : 6,793,334 B2
DATED : September 21, 2004
INVENTOR(S) : Blackman et al.

It is certified that error appears in the above-identified patent and that said Letters Patent is hereby corrected as shown below:

Column 17,
Line 16, delete “paths” and insert in lieu thereof -- path --.

Signed and Sealed this

Nineteenth Day of April, 2005

JON W. DUDAS
*Director of the United States Patent and Trademark Office*